United States Patent [19]

Simon

[11] 3,945,627

[45] Mar. 23, 1976

[54] BOX SPRING ASSEMBLY USING MODULAR COIL SPRINGS

[75] Inventor: LeRoy J. Simon, Chicago, Ill.

[73] Assignee: Serta, Inc., Chicago, Ill.

[22] Filed: Oct. 29, 1974

[21] Appl. No.: 518,775

[52] U.S. Cl. ..... 267/108

[51] Int. Cl.[2] ..... F16F 3/02

[58] Field of Search ..... 267/110, 111, 112, 108, 267/109, 103; 5/199, 252

[56] References Cited

UNITED STATES PATENTS

| | | | |
|---|---|---|---|
| 1,430,249 | 9/1922 | Morse | 267/108 |
| 2,829,706 | 4/1958 | Markle | 267/108 |
| 3,042,395 | 7/1962 | Cole et al. | 267/108 |

*Primary Examiner*—James B. Marbert
*Attorney, Agent, or Firm*—Theodore Anderson

[57] ABSTRACT

A resilient foundation assembly for furniture expecially a box spring for supporting a mattress. A frame means which defines a generally planar foundation area, a grid means overlaying and spaced in a plane above and generally parallel to the foundation area plane and a plurality of spring units resiliently connected between the frame means and grid means. The spring units are formed of a single length of wire and comprise two end segments and a plurality of dual counter reaction modular coil springs contiguous therebetween. Each dual counter reaction spring comprises two leg sections extending downwardly from the grid plane toward the planar foundation area formed by the frame means, the two leg sections are joined by a bridging segment of wire lying in the grid plane. Each leg section is formed by linear segments of wire positioned in predetermined angular relationships and joined by a coil section of wire.

16 Claims, 6 Drawing Figures

BOX SPRING ASSEMBLY USING MODULAR COIL SPRINGS

BACKGROUND OF THE INVENTION

This invention relates to a resilient foundation support structure or assembly for items of furniture. In one particular application, the invention is directed to box spring assemblies used for supporting mattresses. However, the present invention is not limited to foundation supports for mattresses but includes any other item of furniture in which such a support structure is required specifically, chairs, sofas and other types of upholstered furniture.

The standard prior art box spring comprises a wooden rectangular frame, the longer sides of which are connected by a plurality of transverse wooden slats or members, a plurality of individually acting coiled springs mounted in a spaced relationship along the frame and the slats, and a supporting web of light wire interconnecting top portions of each individual coiled spring. The entire upper surface and sides of this structure are covered with cloth or other suitable sheet material. Other common prior art structures involved the substitution of tortion bars in place of the coiled springs. However, in both of these prior art structures, the individual supporting units act independently of one another.

In order to obtain the appropriate desired firmness in such assemblies, it is frequently necessary to incorporate along the perimeter of the frame additional springs which act as stabilizers or to use a very heavy (low gauge) wire to form the springs. These stabilizers provide edge support along the frame. In addition to the above structural limitations in the prior art the box spring assembly requires a great deal of manual labor in its construction. Each individual spring has to be hand positioned onto the frame or slats and secured thereto and then attached to the top web or grid structure. Naturally the amount of hand labor involved in this assembly process greatly increases the cost of the prior art box springs and makes assembly time quite lengthy. In addition, in the prior art box springs it was impossible to optimize both durability and firmness. If the coil springs are tensioned to provide a high degree of firmness, the life or durability is reduced and if the durability is increased, the tensioning of the spring became so slight that the firmness is unsatisfactory and additional springs or stabilizers have to be added to the box spring unit.

SUMMARY OF THE INVENTION

The preferred embodiment of the present invention is in a box spring assembly used to support a mattress. The box spring assembly comprises a frame defining a generally planar foundation area having two long side members connected by two transverse end members and a plurality of slats connected between the two side members, a plurality of spring segments are formed as a continuous spring unit extending from one side member to the other. The units are mounted in a predetermined pattern on the frame and slats which together form a spring receiving means and a lacing or web of top wire forming a grid plane interconnects the spring segments to one another and to adjacent units. A resilient border wire defining a closed loop which is coplanar with the web or grid of top wire and runs above the entire periphery of the frame and is connected to the ends of each spring unit.

Each spring unit comprises a unitary length of wire which extends in a convoluted pattern from one side member of the box spring assembly to the other and in a direction generally parallel to the tranverse slats. Each spring unit begins and terminates with an end section between which are formed the plurality of spring segments or dual counter reaction modular coils. The modular spring segments are fastened to the lacing or webbing wire and to the frame or slats and the end sections are connected to a border wire which follows the periphery of the frame. The entire spring unit is formed from a single piece of wire and the first and last dual counter reaction modular coils are integrally connected to the end sections while adjacent modular springs are integrally connected to one another.

For the purpose of description consider that a modular spring begins at the height or level of the lacing or grid of top wire above the frame. The spring unit has an axis along which bridging lengths of wire interconnect two halves of a modular spring to be described fully hereinafter. The wire which forms one-half of a modular spring is substantially normal to the bridging length of wire and extends at an acute angle downward for approximately one-half of the height or distance that the lacing or web of the top wire is spaced above the frame, thereby forming a first linear wire section. At this point, a small coil is formed in the wire with an axis generally parallel to the axis of the spring unit, and thus parallel to the frame slats. The modular spring wire continues downward from the coil but at an acute angle substantially opposite the angular direction of the initial or first section of wire thereby forming a second linear wire section. The second linear wire section is shorter than the first and thus extends to a reference point short of a position directly under the spring unit axis and above the frame. The reference point is located above the frame approximately one-fourth of the distance from the top wire to the frame and displaced slightly under the first linear section. This second linear section is connected to a third linear section which extends directly downward to the frame thereby forming a third linear wire section. The bottom of the third section abuts a frame end member or slat and a fourth or support section is formed generally normal to the third section and normal to the unit axis. This support section rests on the frame and may be secured thereto. This completes a leg or half of the dual counter reaction spring segment.

The fourth wire section is formed with an additional generally perpendicular bend to form the bight section which interconnects two modular spring segments. This bight portion also lies on the frame and it is generally parallel to the upper bridging wire portions.

The other half of the modular spring segment is formed identically to that already described and extends downwardly from the bridging section and forms another bight section at the bottom of the foundation. This half of the spring segment has the same four sections described above, except, of course, the bends connecting the bight portion to the fourth portion, and the first portion to the bridging portion are in the opposite sense. Also, the coil portion is wound in the opposite direction.

Thus, one modular segment comprises two leg sections, each leg section comprises a first, second, third and fourth linear section and a coil; and a bridging section connecting the two leg sections together along the unit axis. The adjacent dual counter modular coil spring segments in each spring unit are connected together by the bight sections.

Since in each spring unit several dual counter reaction modular coil spring segments are formed, once the second half of the modular spring segment is completed the wire continues to form approached segments. This repetitive spring forming process is completed when the opposite side of the box spring is approached by the spring unit. Each end of the spring unit is finished with an end segment.

With this modular spring design, a force or weight applied to the top of the spring the first section of wire is moved downward and this action forces a complex combination of changes. The first linear section rotates and bends causing the coil section to close or decrease in diameter. The lower or second section of wire is also forced to bend and rotate downward pivoting around the reference point at which the second wire section turns to form the directly downward extending third section. The third wire section will also experience a bending moment at the junction with the fourth section. For a particular box spring assembly, a plurality of spring units are arranged in columns so that the dual counter reaction spring segments in adjacent parallel spring units fall into parallel rows or a predetermined pattern.

It is an object of the present invention to provide a box spring or foundation assembly which has a high degree of firmness and is yet very durable.

It is a further object of the present invention to provide a box spring assembly in which the plurality of spring units which form the foundation are easily assembled and manufactured. Each spring unit is formed of a single length of wire which is manipulated into an end segment, a plurality of dual counter reaction modular spring segments and a final end segment. The width of the box spring can be varied by merely increasing or decreasing the number of modular spring segments in each spring unit. The length of the box spring can be varied by merely increasing or decreasing the number of spring units.

It is an additional object of the present invention to provide a box spring assembly which is light in weight and low in cost due to a reduction in the number of springs necessary and in the decrease in wire gauge needed to obtain an acceptable degree of firmness.

It is yet a further object of the invention to provide individual dual counter reaction modular coil springs which are joined together to form a spring unit; a plurality of spring units are combined to form a box spring assembly.

BRIEF DESCRIPTION OF DRAWINGS

Further and additional objects will appear from the following detailed description of the specific embodiment read in conjunction with the accompanying drawings, wherein.

DETAILED DESCRIPTION OF THE DRAWINGS

Figure 1:
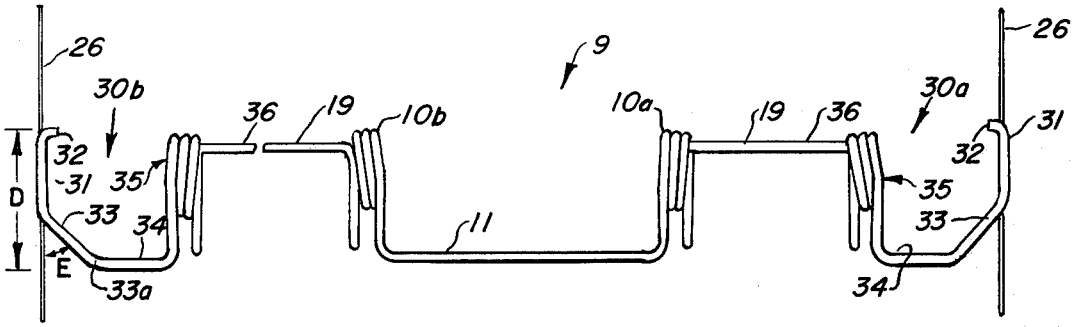
FIG. 1 is a top view of a fragment of a single spring unit which illustrates the two end segments and a modular spring segment.

FIG. 1 illustrates a top view of a single spring unit. The spring unit comprises two end segments 30*a* and 30*b* and complete modular spring segment 9 (only one modular spring is illustrated). The entire spring unit is formed from a single length of wire, however, for ease of description the end segments 30*a* and 30*b* and the modular spring segment 9 may be described and referred to as separate elements.

The end segment 30*a* is fastened to the border wire 26 which runs above the perimeter of the frame. A portion 31 of the end segment 30*a* runs parallel to the long side frame members and to the border wire 26 and is fastened to the border wire by any well-known means such as a clip (not illustrated). The portion 31 has a small bend inward or curl 32 to avoid snagging any fabric covering which can eventually be placed over the entire structure. The end segment has a depth D and the portion 31 extends 3/5 D at which point the wire is bent at an angle E to form portion 33 which continues until the overall depth D is traversed. The wire is formed at an angle complementary to angle E at point 33*a* and runs for a predetermined distance perpendicular to the border wire 26 forming end bridge portion 34. The wire is formed adjacent end bridge 34 to define an end segment leg portion 35 which extends downward to the frame where the bight portion 36 extends along a slat to join a modular coil spring. The leg portion 10*a* and 10*b* of the modular coil spring 9 would be identical to the leg portion 35 of end segment 30*a* as further discussed hereinbelow.

The bight section 19 of the leg portion 10*a* runs along the frame joining bight portion 36 of the end segment 30*a*. The modular spring 9 comprises two leg portions 10*a* and 10*b* which are connected by bridging segment 11. The second leg 10*b* (the leg on the left as FIG. 1 is viewed) is secured to the frame and forms the modular spring bight section wire 19 which runs along the frame until an adjacent modular spring (not illustrated) is formed. Bight wire segment 19 is fastened to the frame by any well-known and suitable means. There are a plurality of modular springs 9 formed during the length of the spring unit in a repetitive sequence which terminates with an end segment 30*b*. Naturally the end segment 30*b* is the reverse image of end segment 30*a*. The number of modular springs formed in any spring unit can be varied to change the width of the box spring. The last modular spring in the spring unit connects with the end segment 30*b* in the same manner in which the first modular spring connects with end segment 30*a*.

Figure 2:
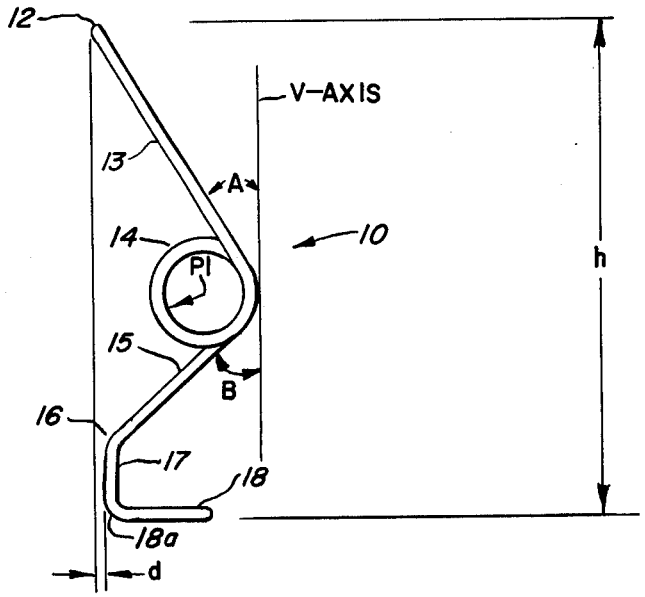
FIG. 2 is a side view of a modular spring segment.

FIG. 2 illustrates a side view of the dual counter reaction modular coil spring 9. This view shows the leg portion 10 which is identical to the leg portion 35 of the end segment 30. In the modular spring 9, two similar leg portions 10*a* and 10*b* are connected by the bridging segment 11 (illustrated in FIG. 1). The length of the bridging wire segment 11 which forms the connection between the two leg portions 10*a* and 10*b* is not critical to the proper operation of the modular spring but is generally slightly shorter in length than the height *h* of the modular spring. The bridging section of wire 11 lies along the axis of the spring unit. At point 12, the connecting or bridging segment 11 terminates and the first leg of the modular spring begins. From point 12, a first or upper linear segment 13 of the spring extends downward towards the frame (not illustrated) and forms an angle A measured from the vertical axis V. In the preferred embodiment, the angle A equals 32°. This angle could also be measured from the horizontal or the planar foundation area formed by the frame means thereby the complement of angle A is equal to 58°. The distance from the frame to the connecting wire 11 or point 12 is designated *h*. The upper portion 13 extends in this downward fashion forming angle A until slightly more than one-half of the height *h* has been traversed. The first or upper linear segment of wire 13 now forms a coil portion 14 by circling in the clockwise direction. In the preferred embodiment two coils are formed but multiple coils or a single coil are possible modifications. After the circular coil portion 14 has been formed, the wire extends to a second or lower linear portion 15. The second or lower linear portion 15 extends downwardly and (in an opposite direction to the first or upper section 13) forms an angle B measured from the vertical axis V. In the preferred embodiment angle B equals 45°. The lower portion 15 is shorter than the first portion 13 and hence extends to a reference point 16 which is slightly to the right of point 12 by a distance *d* (as viewed in FIG. 2). The point 16 is down approximately three-fourths of the height *h* from the point 12 or the connecting or bridging wire segment 11. At point 16, the lower or second portion 15 of the wire turns and proceeds vertically downward forming a third linear segment 17. The third segment 17 of the wire extends from point 16 vertically downward for the remainder of the height *h* until the frame is reached. The third linear segment 17 of the wire will contact the supporting frame or slats at point 18*a*. A fourth or support linear section 18 is formed normal to said third section 17. The fourth section 18 rests on the frame and may be secured thereto. This fourth section 18 formed with a generally perpendicular bend to form the bight section 19 (as shown in FIG. 1) which interconnects two modular springs or a modular spring and end section (by joining end segment bight portion 36). The bight portion 19 of the modular spring wire is connected to the frame by staples or other appropriate fastening means (not illustrated). The connecting or bridging segment 11 continues in a parallel relationship to the slats for a predetermined distance and then turns downward to form the second leg 10*b* of the modular spring segment 9. When a force or weight is placed upon the connecting segment 11, the dual counter reaction modular spring as a whole will compress. As the force is virtually applied to point 12, the first or upper linear arm 13 will be forced in a downward direction. Since the point 12 is to the left of the center point P1 of the circular coil 14 as illustrated in FIG. 2, the downward action of upper segment 13 will cause the coil 14 to close or contract. After coil 14 has contracted, the downward force causes the second linear wire segment 15 also to move in a downward direction pivoting about the reference point 16. The point 16 is slightly to the right of point 12 but substantially in to the left of the center point P1 of the coil 14. Therefore, the point 16 acts as a fulcrum and the lower section 15 as a moment arm. This arrangement relieves the stress which would normally be placed on the wire section 36 at the point of fastening to the frame or slat. This form also reduces any tendency of the entire modular spring 9 to lean or tilt. It should be noted that the coil 14 could open when force is applied to the top of the modular spring by counter winding. Another manner which could accomplish this operation would be to have the first section 13 bend to the right of the center point P1 so that the force applied would act at a point to the right of the center point P1 of the coil 14. If the force is effective at a point to the right of the center point, the coil will open under applied pressure instead of closing.

Figure 3:
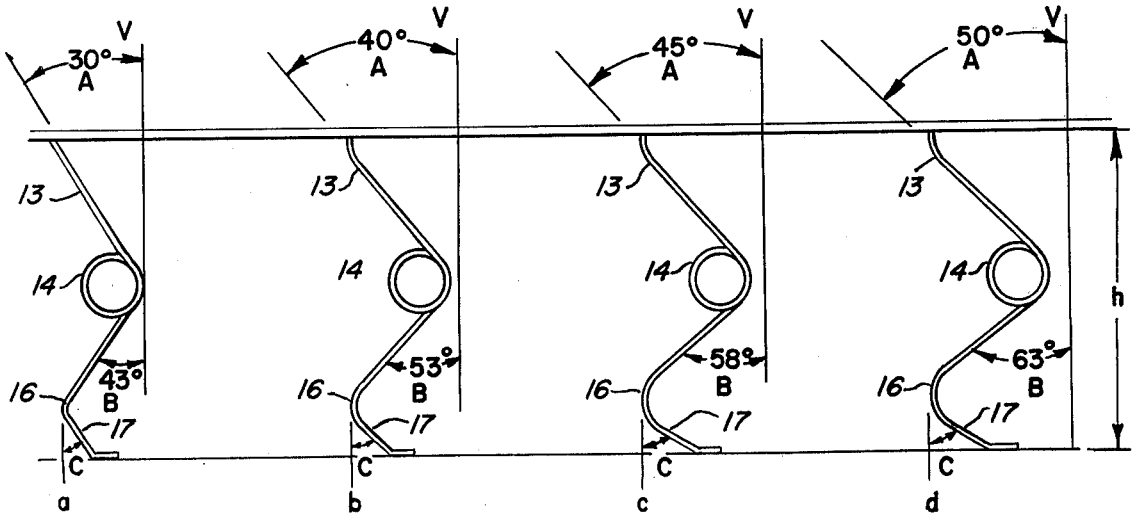
FIGS. 3*a–d* are a plurality of alternative leg section embodiments which illustrate different compression options for a modular spring segment.

FIGS. 3*a* through *d* illustrate a plurality of different compression options available with the dual counter reaction modular spring. As can be seen, the angle A between the upper wire segment 13 and the vertical axis V is 30° for FIG. 3*a* and progress to 50° as shown in FIG. 3*d*. It should be understood that any other angle would be possible within a working range of about 15° to about 75°; that is, of course, between about 75° and 15° to the plane of the foundation frame. As is apparent from these figures, as the angle A increases, the angle B between the vertical axis V and the lower segment 15 also increase by the same number of degrees and the point 16 changes from a reference point of turning into a curve having a larger and larger radius of curvature and therefore having the third segment 17 forming a progressively greater angle as measured from the vertical axis V. The height *h* from the connecting segment 11 to the frame (not illustrated) remains constant.

The greater the angle A becomes the less the spring is tensioned and hence the softer the foundation will be. Therefore, the firmest box spring will be formed from the spring illustrated in FIG. 3*a* and the softest from FIG. 3*d*.

Figure 4:
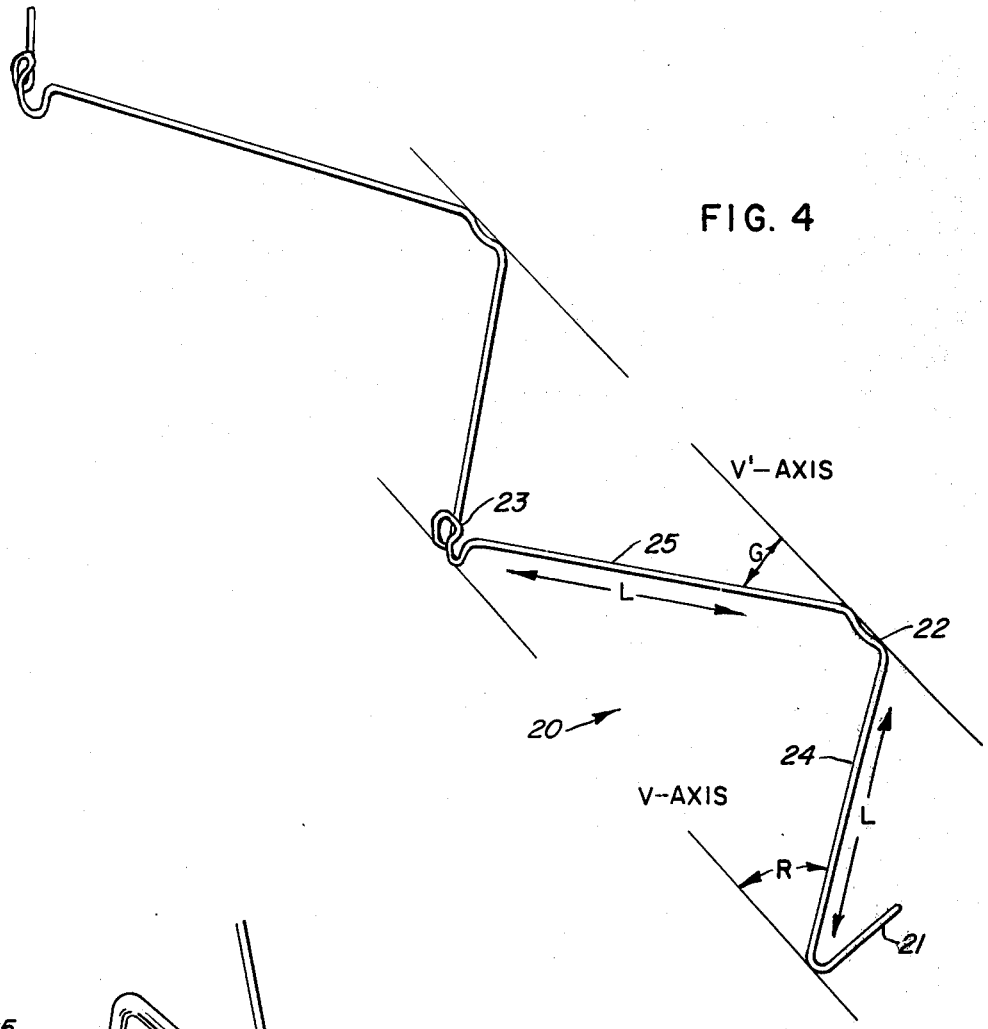
FIG. 4 illustrates the form of the top wire grid.

FIG. 4 illustrates the segment of the lacing or web of top wire generally indicated at 20. The top wire has a small segment 21 which will be connected to a support wire running around the periphery of the frame. The top wire comprises two main features: First, the outer lock or female portion 22; and second, the interlock or male portion 23. Both the male and female portion respectively 23 and 22, are repeated through the entire length of top wire. The top wire design forms a zigzag pattern. The segment 24 of wire forms an angle R measured from the vertical axis V. The segment of wire 24 extends for a particular predetermined length *l*. At the end of length *l*, the female section 22 is formed. The female section 22 is formed of a short piece of wire contiguous with the section 24. The female section of wire 22 is substantially perpendicular to segment 24 and has a very slight dip or curve. The female section 22 is short in length and at its termination a second segment 25 of wire of the same length *l* is formed making an angle G with the vertical axis V'. At the end of segment 25, the male section 23 contiguous therewith is formed. The male section 23 comprises a raised and curved hook section which forms an interlocking relationship with the corresponding female section (not shown) of an adjacent segment of the lacing of top wire. This pattern of top wire design is repeated a sufficient number of times to extend across the width of the box spring and to interconnect the various dual counter reaction modular springs positioned on the frame and slats.

Figure 5:
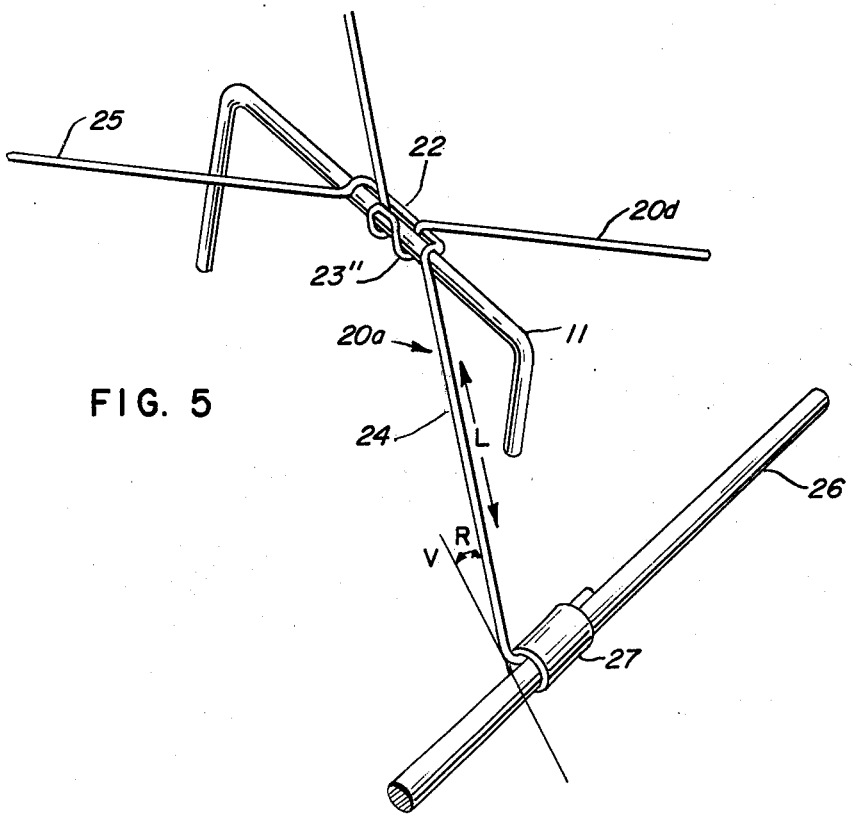
FIG. 5 illustrates the interconnection between fragments of two wires of the top wire grid and a fragment of a modular spring segment.
Figure 6:
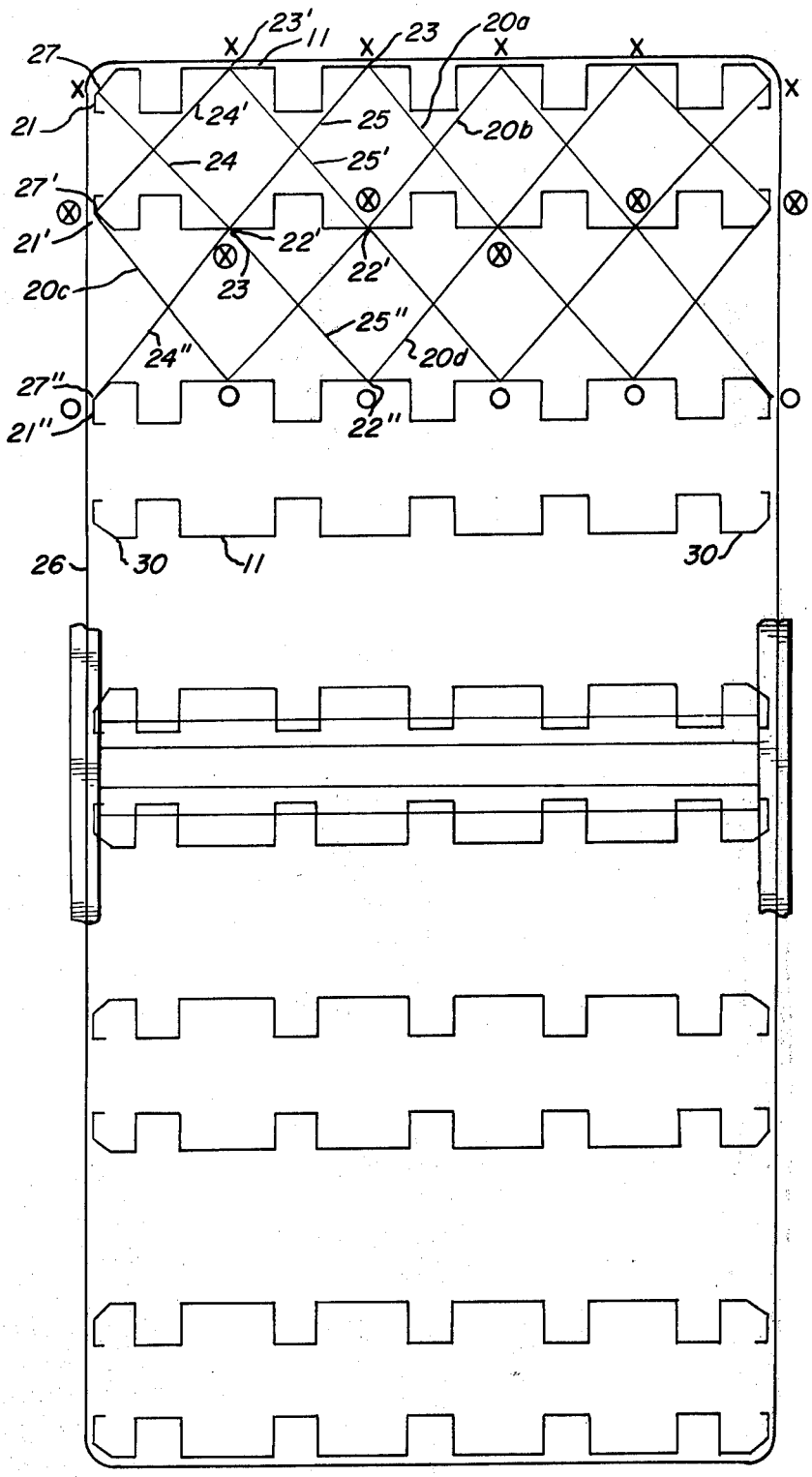
FIG. 6 illustrates diagrammatically the lacing design of the top wire grid and the connection to the modular spring segments.

FIG. 5 illustrates the mating of the male portion 23 with the female portion 22 to support the top or bridging section 11 of the dual counter reaction modular spring 9 and the connection between the end segment 21 of the top wire 20 with the side wire frame 26. Initially the segment 21 of the top wire 20*a* is connected with the side or support wire 26 by means of a clip 27 or other suitable means. The segment 24 of the top wire 20*a* extends at an angle R from the vertical axis V for length *l*. At the termination of wire segment 24 the female section 22 of the top wire 20*a* is formed. At this point, as is seen in FIG. 6, the male portion from the adjacent and parallel top wire design 20*d* will mate with the female portion 22 thereby forming an interlock. Within this interlocking relationship is the bridge or connecting segment 11 of the dual counter reaction modular spring 9. Therefore, the top wire segments 20*a* through 20*n* will form a crisscrossing pattern with male and female portions interlocking and forming support connections for the top segments 11 of the modular springs 9.

FIG. 6 illustrates the entire box spring assembly with a portion of the top wire lacing or web 20 properly positioned and a fragmentary section of the frame means. The remainder of the top wire or webbing 20 follows the same pattern and is not illustrated for the sake of clarity. In FIG. 6, the side supporting wire 26 will run around the entire periphery of the box spring. There is a plurality of top wire segments 20*a* through 20*n* which extends across the box spring in a crisscross pattern with two top wire segments 20*a* and 20*b* in a parallel channel. The first top wire segment 20*a* begins by connecting wire 21 by clip 27 to the supporting wire 26. The top wire design 20*a* continues with the first segment 24 extending to the female portion 22 (illustrated by O) and then continuing with the second length of wire 25 extending to the male portion 23 (illustrated by X). This initital wire pattern is repeated until the opposite side of the box spring and supporting wire 26 are reached. A second length of top wire design 20*b* begins with the connection of the segment 21′ to the same border or supporting wire 26 by a clip 27′. Top wire segment 20*b* extends to a length of wire 24′ which terminates with the male connector 23′ which thereby unites by any well-known means with the supporting wire 26. Now, extending from the male connector 23′ the second segment of wire 25′ extends to the female connector 22′. As previously, this pattern is again repeated throughout the length of the box spring and terminates at the opposite side on support wire 26. Another top wire 20*c* begins with the connection to the border 26 at clip 27′ or if desired slightly separated from clip 27′ thereby requiring an additional clip. The top wire design 20*d* begins with the connection of wire segment 21″ to the top wire support 26 by clip 27″ and continues forming wire segment 24″ which ends with the male connector 23″. This top wire design 20*d* continues forming wire segment 25″ which ends in female connector 22″. This same sequence is repeated until the top wire design terminates at border wire 26. The male connector 23″ of top wire 20*d* locks with the female connector 22 of top wire 20*a*. The male connector 23′ of top wire 20*b* locks onto the border wire 26 and interconnects the connecting segment 11 of the modular spring adjacent to the border wire. This interlocking connects the top wire with section 11 of a single dual counter reaction modular spring. Each individual spring is similarly interconnected in the top wire web or lace network. As can be seen in FIG. 6, the spring units extend traversely across the box spring. The width of the assembly can be increased or decreased by the addition or subtraction of modular springs 9. The length of the box spring is altered by varying the number of spring units. Naturally to comply with the lacing design the spring units must be added or subtracted in pairs. The modular spring segments 10 of adjacent spring units form parallel rows along the length of the assembly thereby providing a pattern which increases firmness.

It is to be understood that the present disclosure can be modified or varied by applying current knowledge without departing from the spirit and scope of the novel concepts of the invention.

I claim:

1. A resilient foundation assembly comprising:

a. frame means defining a generally planar foundation area;

b. grid means overlying and in spaced parallel relationship from said frame means over said foundation area, and c. a plurality of spring units resiliently supporting said grid means and frame means in said spaced relationship, said spring units being disposed in generally spaced parallel relationship and extending across said foundation area, each of said spring units comprising a plurality of modular wire spring segments, each of said spring segments including a first leg section comprising a first linear portion extending downward from a point in the plane of said grid and disposed at an angle relative to an axis normal to the plane of said frame, a coil portion formed at the free end of said first linear portion, and a bottom portion extending downwardly from said coil portion and disposed at an angle relative to said normal axis different in magnitude than said first linear portion angle, the free end of said bottom portion contacting said frame, whereby varying the compressive forces between said frame means and said grid means produces rotating moments in said first linear portion and said bottom portion and a winding force in said coil portion.

2. The assembly of claim 1 wherein each of said spring segments of said unit further comprises a second leg section extending downward from the plane of said grid and being a mirror image of said first leg section, a bridging section in the plane of said grid for connecting said first and second leg sections wherein said first and second leg sections and said bridge section are formed from a single continuous length of wire.

3. The assembly of claim 2 further comprising bight portions of wire lying in the plane of said frame and connecting the spring segments wherein the plurality of spring segments of each spring unit including bight portions therebetween are formed from a single continuous length of wire.

4. The assembly of claim 1 where said frame means comprises two generally parallel side members, two end members extending transversely between the respective end portions of said side members and a plurality of slats extending generally parallel to said end members between said side members, said end members and slats defining spring receiving means and said bottom portions being secured to said spring receiving means.

5. The assembly of claim 1 including an elongate, resilient border member defining a closed loop generally coplanar with said grid means and surrounding the periphery of said foundation area, said ends of said spring units being secured to said border member.

6. The assembly of claim 1 wherein each end of each of said units having an end segment transverse to the axis of said unit.

7. The assembly of claim 1 wherein said angles are acute in the range of about 75° to about 15°.

8. The assembly of claim 1 wherein the angle of said first linear portion is acute and about 30° and the angle of said lower portion is acute and about 45°.

9. The assembly of claim 1 wherein said bottom portion comprises, a second linear portion extending downward from said coil and terminating at a reference point above the plane of said frame, and a third linear portion integrally connected to said second portion at said reference point and extending downward to contact said frame and being disposed at an angle relative to said normal axis.

10. The assembly of claim 9 wherein said third linear section is generally normal to the plane of said frame.

11. The assembly of claim 9 wherein said third portion contacts said frame means at a point displaced toward said coil means relative to said point in the plane of said grid at which said first portion began to extend downward.

12. The assembly of claim 1 wherein the axis of said coil portion lies in a plane generally parallel to said plane of said frame means.

13. The assembly of claim 1 wherein said grid means comprises a plurality of grid wires each lacing diagonally back and forth between two adjacent spring units and alternately connected thereto throughout their length.

14. The assembly of claim 1 wherein said grid means comprises a plurality of grid wires, each lacing diagonally back and forth between two adjacent spring units and alternately being connected to said bridging portions.

15. The assembly of claim 9 wherein said reference point is spaced a horizontal distance from said point in the plane of said grid at which said first linear portion began to extend downward whereby the area at said reference termination point acts as a fulcrum when the compressive forces between said frame means and said grid means are varied.

16. The assembly of claim 1 wherein said free end of said bottom portion contacts said frame at a point spaced a horizontal distance from said point in the plane of said grid at which said first linear portion began to extend downward.

* * * * *

UNITED STATES PATENT OFFICE
CERTIFICATE OF CORRECTION

PATENT NO. : 3,945,627
DATED : March 23, 1976
INVENTOR(S) : LeRoy J. Simon

It is certified that error appears in the above-identified patent and that said Letters Patent are hereby corrected as shown below.

Column 3, line 8, "approached" should read --other spring--;

Column 4, line 26, "extends" should read --extends approximately--;

Column 5, line 41, "formed" should read --is formed--;

Column 8, line 67 (claim 5), "1" should read --6--; and

Column 10, line 9 (claim 14), "1" should read --2--.

Signed and Sealed this
Seventeenth Day of August 1976

[SEAL]

*Attest:*

RUTH C. MASON
*Attesting Officer*

C. MARSHALL DANN
*Commissioner of Patents and Trademarks*